US008910393B2

(12) United States Patent
Kuhn et al.

(10) Patent No.: US 8,910,393 B2
(45) Date of Patent: Dec. 16, 2014

(54) DRYING APPARATUS FOR POURABLE MATERIAL AND METHOD FOR PRODUCING A DRYING APPARATUS FOR POURABLE MATERIAL

(75) Inventors: Günter Kuhn, Bad Mergentheim (DE); Wolfgang Fix-Mumme, Leverkusen (DE); Reinhard Kassner, Güntersloh (DE)

(73) Assignee: Dieffenbacher GmbH Maschinen—und Anlagenbau, Eppingen (DE)

( * ) Notice: Subject to any disclaimer, the term of this patent is extended or adjusted under 35 U.S.C. 154(b) by 1175 days.

(21) Appl. No.: 12/311,572

(22) PCT Filed: Oct. 4, 2007

(86) PCT No.: PCT/EP2007/008622

§ 371 (c)(1),
(2), (4) Date: Nov. 20, 2009

(87) PCT Pub. No.: WO2008/040545

PCT Pub. Date: Apr. 10, 2008

(65) Prior Publication Data

US 2010/0154243 A1 Jun. 24, 2010

(30) Foreign Application Priority Data

Oct. 4, 2006 (EP) ..... 06020815

(51) Int. Cl.
*F26B 11/02* (2006.01)
*F26B 11/04* (2006.01)

(52) U.S. Cl.
CPC ..... *F26B 11/0477* (2013.01)
USPC ..... 34/108; 34/130; 34/135; 34/239; 432/118

(58) Field of Classification Search
CPC ..... F26B 11/0477
USPC ..... 34/108, 109, 130, 239, 135; 432/103, 432/118
See application file for complete search history.

(56) References Cited

U.S. PATENT DOCUMENTS 3,036,822 A * 5/1962 Andersen ..... 432/118
3,407,511 A 10/1968 Camm (Continued)

FOREIGN PATENT DOCUMENTS

CA 2 289 267 5/2001
CA 2 544 671 12/2005

(Continued)

OTHER PUBLICATIONS

Chinese Office Action and its English Equivalent received in Chinese Patent Appln. No. 200780041893.2 dated May 25, 2010, 18 pages.

*Primary Examiner* — Jiping Lu
(74) *Attorney, Agent, or Firm* — Foley & Lardner LLP

(57) ABSTRACT

A drum or drum segment for a drying apparatus of pourable material having built-in components arranged within the drum, which is rotatable about its central axis. The built-in components thoroughly mix and convey the pourable material from a drum entrance to a drum exit while guiding through a tempered gaseous transport fluid. Several support rings are arranged between the built-in components and the drum. The support rings are arranged to be statically supporting, but compensate tensile and compressive stresses in an elastic manner. The support rings are connected to the built-in components, a support frame and the drum, or a combination thereof A method for producing the drum or drum segments includes pre-mounting modules of built-in components and inserting the modules of built-in components into the drum or the drum segment.

16 Claims, 5 Drawing Sheets

(56) References Cited

U.S. PATENT DOCUMENTS

| | | | |
|---|---|---|---|
| 3,690,628 | A | 9/1972 | Kamstrup-Larsen |
| 4,447,966 | A | 5/1984 | Mollenkopf et al. |
| 4,995,809 | A | 2/1991 | Filges et al. |
| 6,119,363 | A | 9/2000 | Bahner et al. |

FOREIGN PATENT DOCUMENTS

| | | |
|---|---|---|
| DE | 218 705 | 2/1910 |
| DE | 510 396 | 10/1930 |
| DE | 519 980 | 3/1931 |
| DE | 525 825 | 5/1931 |
| DE | 882 842 | 7/1953 |
| DE | 12 77 755 | 9/1968 |
| DE | 20 39 163 | 2/1971 |
| DE | 23 32 626 | 1/1975 |
| DE | 23 62 725 | 6/1975 |
| DE | 86 17 098 | 8/1986 |
| DE | 196 31 998 | 10/1997 |
| DE | 102 08 248 | 9/2003 |
| EP | 0 072 415 | 2/1983 |
| EP | 0 367 956 | 5/1990 |
| GB | 475 509 | 11/1937 |

* cited by examiner

DRYING APPARATUS FOR POURABLE MATERIAL AND METHOD FOR PRODUCING A DRYING APPARATUS FOR POURABLE MATERIAL

CROSS-REFERENCE TO RELATED PATENT APPLICATIONS

This application is a U.S. National Phase of International Application No. PCT/EP2007/008622, filed Oct. 4, 2007, which claims priority to German Patent Application No. 060 20 815.4, filed Oct. 4, 2006. The entire contents of the foregoing applications are incorporated by reference in their entirety.

The invention relates to a drum or drum segment for a drying apparatus of pourable material. The invention further relates to a method for producing a drum or a drum segment for a drying apparatus.

Rotary drums are used for drying pourable material in the processing industry for drying wood chips or other cellulose-containing material. The material to be dried and a heated gas are entered at the entrance to the rotary drum and the dried material and the gas are delivered at the outlet. The relevant aspect for a favorable drying effect is that the material comes into regular contact with the heated gas and an optimal heat transmission can be achieved. The material to be dried is guided by means of mechanical and/or pneumatic transport through a rotating drum made of sheet steel.

In addition, built-in components are usually provided in the drum, which ensure a thorough mixing of the material during the rotation of the drum within the manner of a mixer. The built-in components are either held in stays or are welded or screwed together directly with the drum wall. Preferably, the industry uses so-called cross-shaped built-in components which in addition to thorough mixing also lift off the free-flowing or pourable materials in short intervals, transport the same upwardly and subsequently allow the same to pour down in the further course of the rotation from the top to bottom through the drum. Moreover, the cross-shaped built-in components which plunge into the material disposed on the floor of the drum during the rotation destroy any obstructions or accumulations of the material and ensure an even heating of the material. Cross-shaped built-in components are known for example from DE 23 62 725 B2. It is known from DE 196 31 998 C1 however to install radial built-in components, starting from the circumference of the drum in the direction towards the center of the drum.

Even though not described in detail, it is obvious and known to the person skilled in the art that these built-in components are fixed by welded joints and/or by screwed joints. Depending on the requirements, built-in supporting components may be used or an inside tube is additionally installed in order to ensure the required stability of the built-in components during operation. Reinforcing rings can be attached on the inside, outside or in the drum jacket for improving the stability of the drum, depending on the application. The external reinforcing rings come with the advantage that they can be used as so-called raceways and also as bearings for the entire drum. The drive is usually provided by means of gear ring, chain or frictional wheel drives. In the design, construction and assembly of drum driers it is necessary to provide optimized heat transmission of hot gas to the material to be dried by respective choice and arrangement of the built-in components. It is relevant that local areas which are capable of causing accumulations of the material must be avoided. Otherwise, the material in the drum can ignite due to excessive action of heat. As a result of the high temperatures during operation it is further important to provide construction and production of the drum in such a way that absorbing and compensating thermal tensions by different temperatures and different expansion behavior of the built-in components, the drum jacket and optionally the reinforcing rings are provided. Furthermore, it needs to be ensured that the occurring tensions are absorbed and compensated properly which are caused by the dead weight and the dynamically moving drum and its twisting.

In order to compensate the occurring stresses during operation, and especially during the heating and the conveying of the material, it has been common practice in regard to construction to support the entire construction on sliding elements, joints and/or spring units in the case of rigid built-in components. All these technical built-in parts lead to an increase in the weight of the drum and, optionally, to a certain imbalance. In addition, the problem arises that the material to be dried acts in a strongly adhesive manner and accumulates preferably at such places, and the function of the sliding elements, joints and/or the spring unit is obstructed or even prevented after a number of operational units. The serious consequence is that damage occurs in the drum drier itself.

The probability for faults is also highly dependent on the manner of mounting. It usually occurs by introducing and mounting individual parts during the production in a production plant or at the future location on the construction site. In order to avoid forced positions during the mounting of the individual parts which occurs in the interior of the drum, a regular rotation of the drum is necessary, which again leads to a change in the occurring stresses. For reasons of work safety it is mandatory to completely clear the entire drum prior to each rotation. This includes not only the staff, but also the production implements (welding devices), tools and loose material. A simultaneous and actually useful performance of the mounting work at several places is hardly possible in practice due to these regularly performed drum movements and the occurring exhaust gases during welding. Depending on the number of the individual parts of the built-in components, this has serious consequences on the duration and thus the costs of the mounting, because an immense process of cleaning up and securing is accompanied by each rotation of the drum.

It is the object of the invention to provide a drum or drum segment which with respect to the occurring stresses in the construction of the built-in components and the drum during mounting and operation enables optimal self-compensation and does not have the disadvantages of the state of the art, and to further provide a method for producing a drum or drum segment which avoids the disadvantages of the state of the art as mentioned above and enables simple mounting of the built-in components in the drum with little stress.

The object concerning a drum or a drum segment is achieved in such a way that several support rings are arranged between the built-in components and the wall of the drum, which rings are arranged to be capable of support in a static respect, but are still capable of compensating tensile and compressive stresses in an elastic manner and are connected in a positive and non-positive way with the built-in components and/or their support frame and the drum.

The object for the method is achieved by producing a module for built-in components by mounting built-in components between two support frames, with further metallic support rings which absorb tensile and compressive stresses in an elastic manner being mounted on all sides on the module for built-in components in such a way that they face outwardly, and the module for built-in components with the support rings is introduced into a drum or drum segment and is pre-fixed in a preliminary fashion by means of wedges and/or stitch welding, with subsequently the elastic support rings of the module for the built-in components being connected with the drum or a drum segment in a non-positive and/or positive way.

The drum or drum segment in accordance with the invention is suitable for drying wood chips, cuttings or similar cutting material, especially for so-called flakes or strands in the production of OSB (oriented strand board—board made of aligned chips), but also for drying other free-flowing or pourable material.

The support rings which are open on one side are especially suitable for a) ensuring the stability of the drum;
b) ensuring the absorption of stresses without any sliding elements, joints or springs which are susceptible to faults;
c) providing flexible fastening points for the actual built-in components (e.g. cross-shaped built-in components);
d) promoting the transport of material through the drum in drying operation by a drum cross section which remains free to a comparatively very high extent;
e) enabling the mounting of entire modules of finished stays with built-in components outside of the drum, and
f) considerably reducing the frequency of faults and the duration of mounting.

In a preferred embodiment, the support rings which are open on one side are provided with feet on the open side of the support ring, thus leading to an "omega-shaped" (Q) appearance of the support ring. Detached from the arrangement of the individual stays or cross-shaped built-in components, the connection with the drum jacket is provided through several omega-shaped support rings. The construction which is rigid on the one hand but is still statically tolerant to stresses on the other hand allows completing the mounting of the built-in components in sections outside of the actual drum (welding, screwing) and introducing the same in sections. The type and quantity of the built-in components (crosses, scoops or the like) arranged between the two omega support disks depends on the application, e.g. on throughput and the material to be dried. Within the drum, only the actual connection with the drum jacket needs to be produced via the omega feet. Work in forced positions and/or rotating of the drum during mounting can be avoided. The application of the stays within the omega support disk occurs in a statically optimized way and is also dependent upon the application. In comparison with other solutions, a relatively large part of the drum cross section remains open, thus promoting the transport of material and substantially preventing accumulations. Mounting can occur starting easily from the middle of the drum towards the two ends at the same time, with the cleaning doors which are conventionally provided anyway being used as entrance and exit. The complete pre-assembly away from the construction site and the pre-assembly of complete drum drier segments (drum jacket and built-in components readily installed in 3 or 4 m of axial lengths for example) are also possible. In this case, the individual segments which already comprise the finished built-in components are welded by joining the drum jacket into the actual drum drier. A necessary mounting of built-in components on the construction site itself can then be completed avoided.

Preferably, the feet of the omega-shaped support rings are connected with the drum, with a twisted arrangement obviously also being possible and the bulging portions of the support rings being connected with the drum, with welded and/or screwed joints being arranged. It is also possible to provide plug-in systems for the complete segment of built-in components. In a further embodiment, the width of the flow against support rings in the direction of flow through the drum is approximately equal to the width of flow against the built-in components. In a preferred embodiment, the built-in components are arranged between two circularly arranged support frames, with the circular support frames having a smaller radius than the drum radius and the support rings being arranged between the support frame and the drum.

In one embodiment, of the drum or drum segment the support rings are arranged in the direction of through-flow for avoiding a high air resistance.

Further advantageous measures and embodiments of the subject matter of the invention are provided in the sub-claims and the following description with the drawing, wherein:

Figure 1:
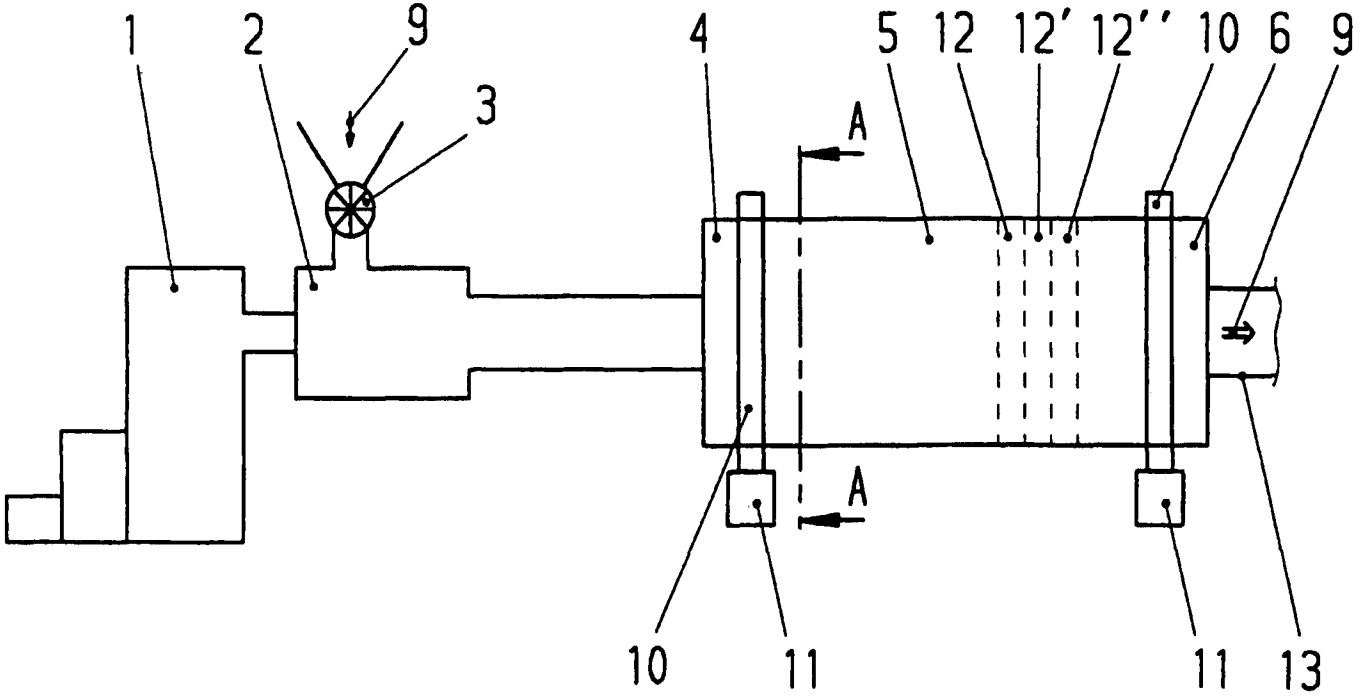
FIG. 1 shows a schematic view of a drying system with a drum or several drum segments in accordance with the invention.

FIG. 1 schematically shows an installation for drying pourable material 9. When using a rotatable drum 5, gas is usually heated in a combustion chamber 1 and supplied to a mixing chamber 2. In the mixing chamber 2, material 9 is fed via an input gate 3 and conveyed via the flow in the direction of the drum 5 towards the drum entrance 4. In the drum 5, the material is thoroughly mixed and subjected to even heating and drying. After the exit of the material 9 from the drum exit 6, it is mostly supplied via pipe connection 13 to a cyclone (not shown) with a star feeder (not shown) and to further treatments or production. Furthermore, drum 5 is provided with raceways 10 on which a drive 11 can act. Within the scope of an illustrated embodiment, drum 5 can consist of several drum segments 12 and drum entrance 4 and drum exit 6 applied thereto. This can have reasons of production or mounting: it is preferably possible that drum segments 12, 12', 12", . . . are produced which are joined at the mounting location into a drum 5. It is obviously possible that the raceways 10 are arranged at other locations on the drum 5 than is described here. Notice must be taken that depending on the amount of mounting work and the mounting possibilities the necessary modules 18 of built-in components are supplied either separate from the drum segments 12 and are assembled on site, or the modules 18 of built-in components are inserted directly after their mounting in a drum segment 12.

Figure 2:
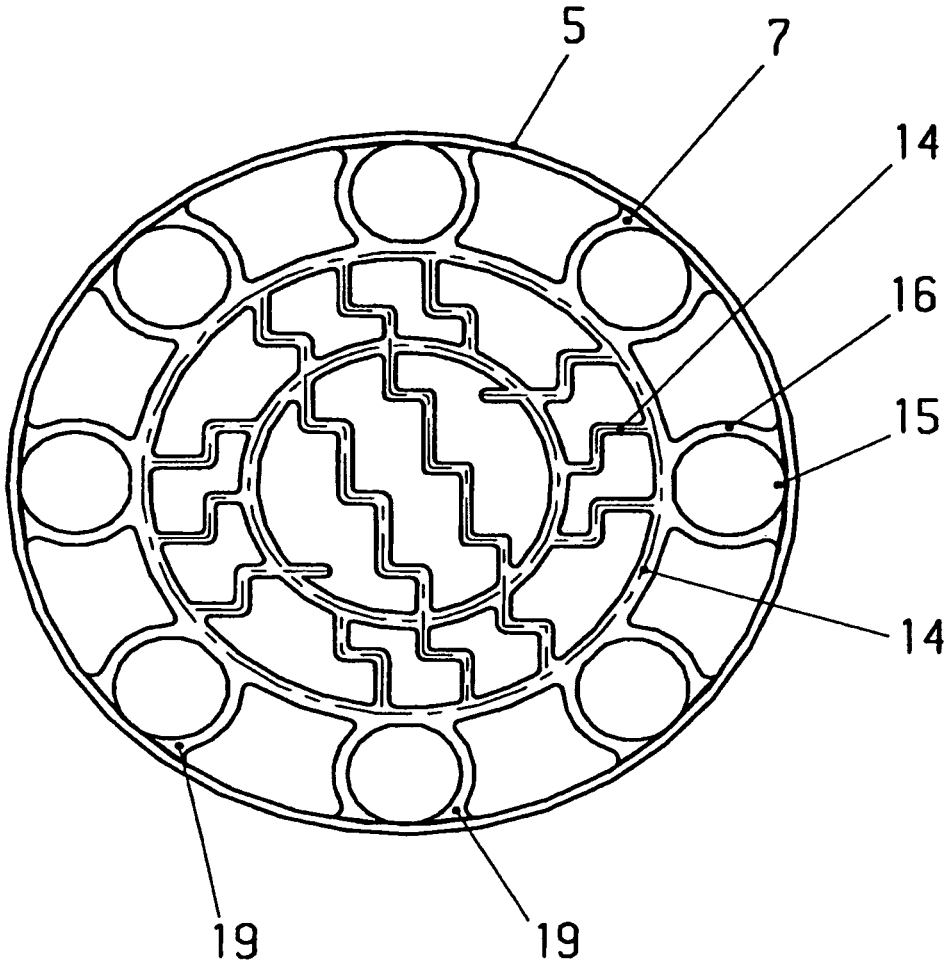
FIG. 2 shows a sectional view through a drum according to FIG. 1 for illustrating the support frame with the support rings.
Figure 3:
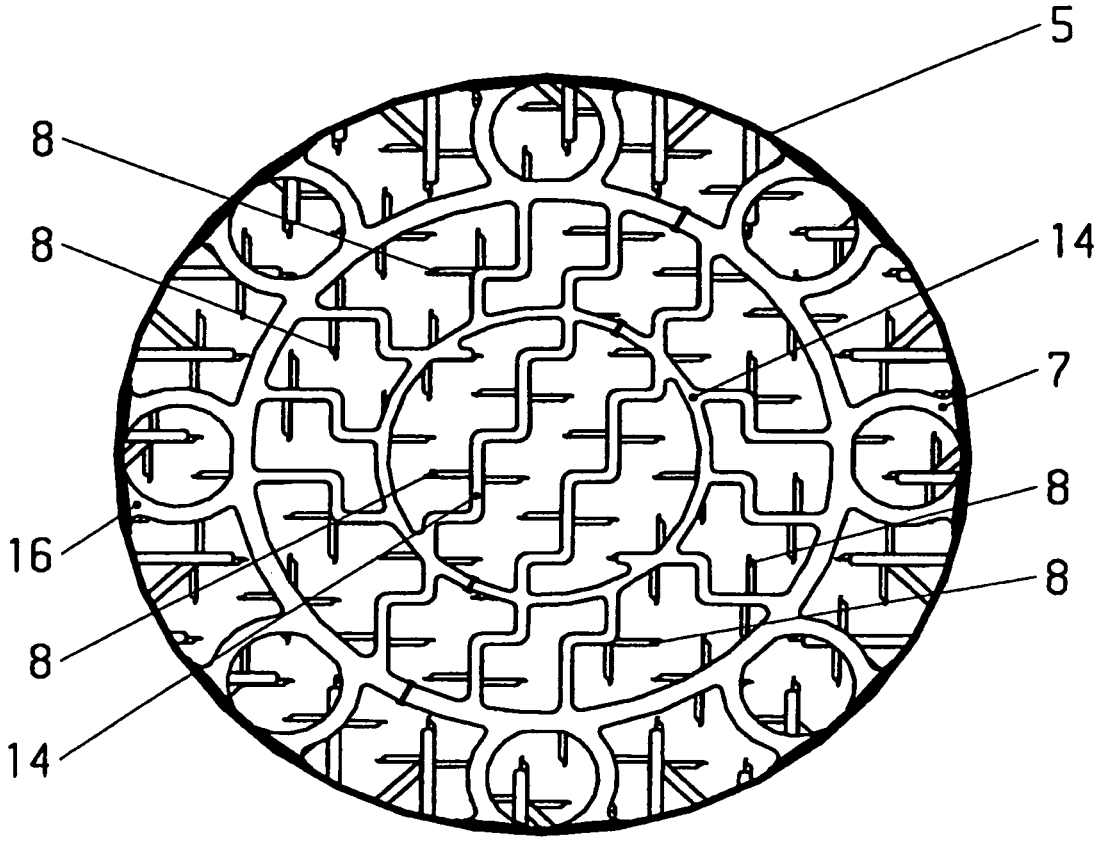
FIG. 3 shows a sectional view according to FIG. 2 with the built-in components on the support frame being additionally entered on the drawing.

FIG. 2 shows a sectional view A-A according to FIG. 1, in which the inside view of a drum 5 or a drum segment 12 is illustrated. It shows how the support frame 14 is held by the support rings 7 in position in an elastic but still statically supporting manner. FIG. 3 shows the built-in components 8 in addition to the support frame 14 and the supporting rings 7 in order to illustrate the difference. The built-in components 8 now lead to the possibility of ensuring optimal thorough mixing and distribution of the material 9 in the drum 5.

In a preferred embodiment, the support rings 7 which are open on one side comprise feet 19 on the side of opening 15 which provide the support ring 7 with an omega-shaped appearance. Within the terms of the invention, the support ring 7 can compensate tensile and compressive stresses which arise from the change of temperature between the mounting and the operating state, which compensation occurs via legs 16 which can deform in an elastic manner, as required. It is thus contributed to stress reduction in an optimal and especially simple way, and the overall construction (built-in components 8, the support frame 14 in conjunction with the drum 5) is not subjected to any damage during operation or during changes of state in running operations.

Figure 4:
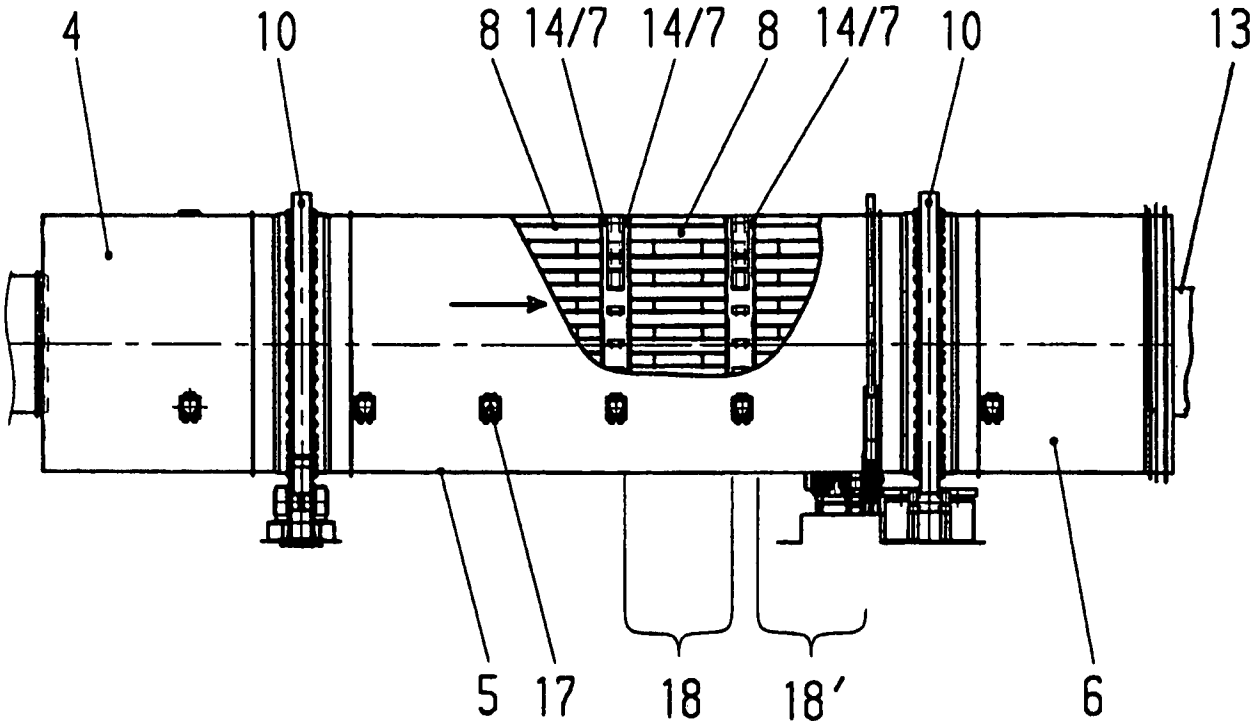
FIG. 4 shows an enlarged side view of a drum according to FIG. 1 with a partly exposed section with an illustration of the modules of built-in components contained therein.

The application decides whether the support rings 7 are arranged in the direction of through-flow (not shown) or offer with their broad sides a similar resistance to through-flow like the built-in components 8 and/or the support frames 14. The application also decides on the types of built-in components 8. In the present example, cross-shaped built-in components 8 are provided. It is obvious however that there are a large number of variations. FIG. 4 shows the arrangement of a drum 5 again by a partly exposed side view. The partly exposed side view shows that several modules 18, 18', . . . of built-in components are installed next to one another in the longitudinal extension of the drum 5. As already described, a drum 5 can also consist of several drum segments 12 which were assembled on site. The support frames 14 with the support rings 7 form the boundary of a module 18 of built-in components. In a preferred embodiment, the maintenance openings (manholes) are arranged precisely between two modules 18 of built-in components in order to offer a service technician the possibility to reach the interior of the drum 5 without any problems. As is shown in FIG. 3, the built-in components 8 of a module 18 reach up close to the wall of the drum, so that there would not be any space for a service technician.

Figure 5:
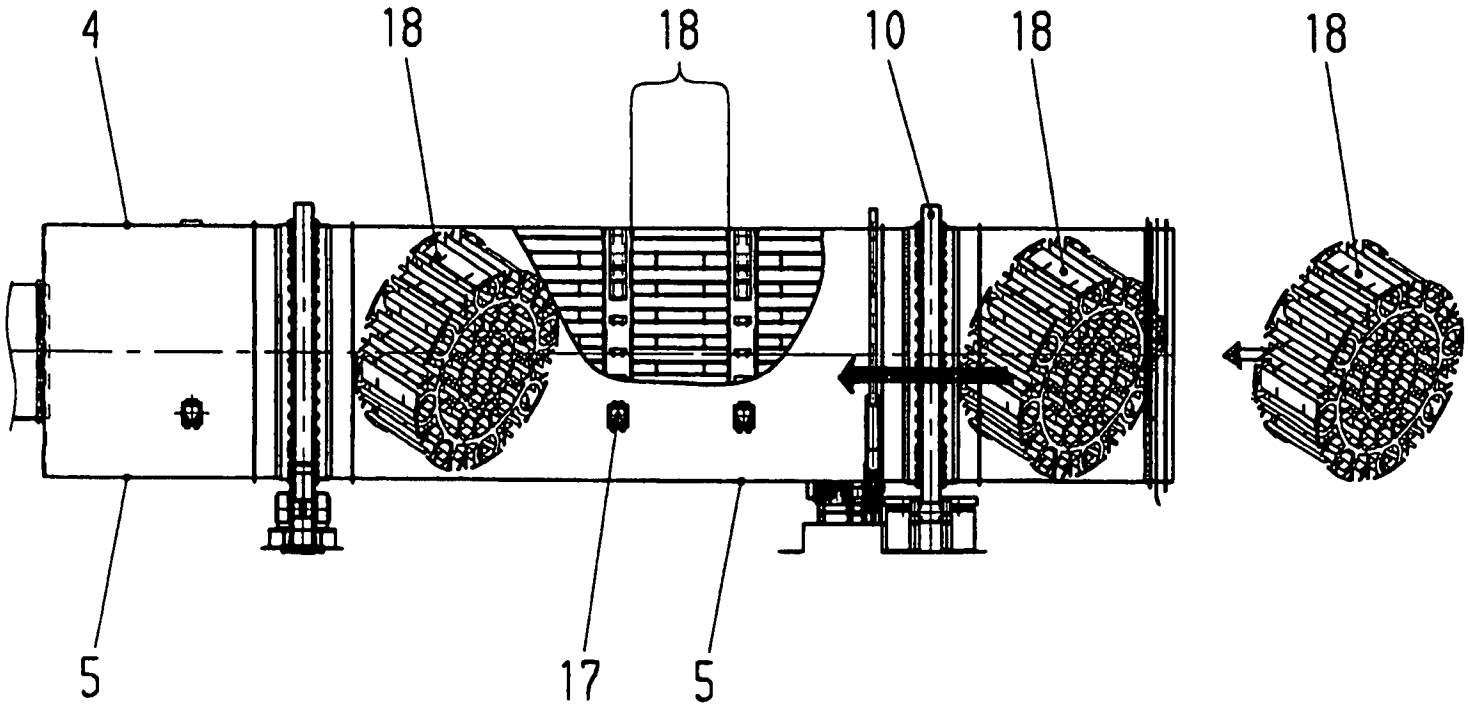
FIG. 5 shows an illustration of the method in accordance with the invention for mounting modules of built-in components in a drum.

In summary of the method (FIG. 5) in accordance with the invention, a module 18 of built-in components is mounted at first from the built-in components 8 and two support frames in the production of a drum 5 for a drier. This can occur advantageously outside of the drum 5 itself, with several workers thus being enabled to work simultaneously on a module 18 of built-in components as a result of the enlarged free access space that was thus created. The support rings 7 are welded onto the same either simultaneously or successively. Finally, the entire module 18 of built-in components is lifted with respective means such as cranes or fork lift trucks into a drum 5 or a drum segment 12 and mounted on the drum 5 or a drum segment 12 during the final mounting. The necessity to rotate the drum 5 or drum segment 12 regularly can be omitted in an advantageous fashion during the mounting of such a module 18 of built-in components in order to thus successively link the support frames to the drum. By introducing a complete module 18 into the drum 5 or the drum segment 12, it is then only necessary to fix the module 18 in a preliminary manner with wedges or stitch welding before the proper connecting means such as welding or screwing is applied. The disadvantages of a necessary rotation of the drum during the mounting or the laborious, cumbersome and cramped mounting of the built-in components in a drum can be avoided.

It can be noted in summary that the presented solutions do not act in any way in a limiting fashion on the inventive idea, but offer the person skilled in the art a large number of possibilities within the terms of the invention as to how the support rings can be arranged in order to enable elastic absorption of stresses in combination with a supporting function of the built-in components.

LIST OF REFERENCE NUMERALS

DP1333EP

1. Combustion chamber
2. Mixing chamber
3. Input gate
4. Drum entrance
5. Drum
6. Drum exit
7. Support ring
8. Built-in components
9. Material
10. Raceway
11. Drive
12. Drum segments
13. Pipe connection
14. Support frame
15. Opening
16. Leg
17. Maintenance opening
18. Modules of built-in components
19. Feet

The invention claimed is:

1. A drum or drum segment for a drying apparatus of pourable material, the drum or drum segment comprising:

built-in components arranged within the drum or drum segment, which is rotatable about its central axis, between two support frames to produce a module of built-in components, the built-in components configured to thoroughly mix and convey the pourable material from a drum or drum segment entrance to a drum or drum segment exit while guiding through a tempered gaseous transport fluid; and a plurality of support rings arranged around a circumference of each of the two support frames between each of the two support frames and the drum or drum segment, the support rings configured to be statically supporting, compensate tensile and compressive stresses in an elastic manner, and connect to the built-in components, a support frame and the drum or drum segment, or a combination thereof, wherein a support ring is at least partially defined by a pair of legs and an opening in a circumference of the support ring disposed between the legs at an area in which the legs contact the drum or drum segment, the opening facing outwardly toward the drum or drum segment.

2. A drum or drum segment according to claim 1, wherein the support rings have a layout in a form of an omega "Ω".

3. A drum or drum segment according to claim 1 wherein the pair of legs of the support ring have corresponding feet connected with the drum or drum segment.

4. A drum or drum segment according to claim 1, wherein bulging portions of the support rings are connected with the drum or drum segment.

5. A drum or drum segment according to claim 1, wherein welded joints, screwed joints, or a combination thereof are arranged between the support rings and the support frame of the built-in components or between the support rings and the drum or drum segment.

6. A drum or drum segment according to claim 1, wherein a width of flow against the support rings in a direction of through-flow of the drum or drum segment corresponds approximately to a width of flow against the built-in components, the support frame, or a combination thereof.

7. A drum or drum segment according to claim 1, wherein a radius of each of the support frames is smaller than a radius of the drum or drum segment.

8. A drum or drum segment according to claim 1, wherein the support ring is further defined by the support frame.

9. A drum or drum segment for a drying apparatus of pourable material, the drum or drum segment comprising:

built-in components arranged within the drum, which is rotatable about its central axis, the built-in components configured to thoroughly mix and convey the pourable material from a drum entrance to a drum exit while guiding through a tempered gaseous transport fluid; and a plurality of support rings arranged between the built-in components and the drum, the support rings configured to be statically supporting, compensate tensile and compressive stresses in an elastic manner, and connect to the built-in components, a support frame and the drum, or a combination thereof, wherein a support ring is at least partially defined by a pair of legs and an opening in a circumference of the support ring disposed between the legs at an area in which the legs contact the drum or drum segment, and wherein a maintenance opening is arranged between two modules of built-in components, each module of built-in components comprises built-in components mounted between two support frames.

10. A method for producing a drum or a drum segment for a drying apparatus of pourable material, the drum or drum segment comprising built-in components arranged within the drum or drum segment, which is rotatable about its central axis, the built-in components configured to thoroughly mix and convey the pourable material from a drum or drum segment entrance to a drum or drum segment exit while guiding through a tempered gaseous transport fluid, the method comprising:

mounting the built-in components between two support frames to produce a module of built-in components;

mounting metallic support rings configured to absorb tensile and compressive stresses in an elastic manner around a circumference of each of the two support frames, each of the support rings being at least partially defined by a pair of legs and an opening in a circumference of the support ring disposed between the legs at an area in which the legs contact the drum or drum segment, the opening facing outwardly toward the drum or drum segment;

introducing the module of built-in components with mounted support rings in the drum or drum segment and pre-fixing the module of built-in components in a preliminary manner with wedges, stitch welding, or a combination thereof;

connecting the support rings of the module of built-in components with mounted support rings to the drum or the drum segment.

11. A method according to claim 10, wherein during production of drum segments, the drum segments are assembled on site into the drum.

12. A method according to claim 10, wherein the support rings are omega-shaped "Q" support rings.

13. A method according to claim 10, wherein the support rings are welded to each of the two support frames, the drum or drum segment, or a combination thereof.

14. A method according to claim 10, wherein the support rings are screwed to each of the support frames, the drum or drum segment, or a combination thereof.

15. A method according to claim 10, wherein each of the support rings is further defined by the support frame.

16. A drum or drum segment for a drying apparatus of pourable material, the drum or drum segment comprising:

built-in components arranged within the drum, which is rotatable about its central axis, the built-in components configured to thoroughly mix and convey the pourable material from a drum entrance to a drum exit while guiding through a tempered gaseous transport fluid; and a plurality of support rings arranged between the built-in components and the drum, the support rings configured to be statically supporting, compensate tensile and compressive stresses in an elastic manner, and connect to the built-in components, a support frame and the drum, or a combination thereof, wherein the built-in components are arranged between two circular support frames, the circular support frames having a smaller radius than a radius of the drum, and wherein the support rings are arranged between the a circular support frame and the drum or drum segment, and wherein a maintenance opening is arranged between two modules of built-in components, each module of built-in components comprises built-in components mounted between two support frames.

* * * * *